US008876264B2

(12) United States Patent
Omer et al.

(10) Patent No.: US 8,876,264 B2
(45) **Date of Patent: *Nov. 4, 2014**

(54) INK DROPLET GENERATION MODULE

(71) Applicant: Videojet Technologies Inc., Wood Dale, IL (US)

(72) Inventors: Salhadin Omer, Cambridge (GB); Jerzy Zaba, Cambridge (GB)

(73) Assignee: Videojet Technologies Inc., Wood Dale, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/713,223

(22) Filed: Dec. 13, 2012

(65) Prior Publication Data

US 2013/0120507 A1 May 16, 2013

Related U.S. Application Data

(62) Division of application No. 12/680,980, filed as application No. PCT/US2008/079484 on Oct. 10, 2008, now Pat. No. 8,360,560.

(30) Foreign Application Priority Data

Oct. 12, 2007 (GB) ..... 0719992.0

(51) Int. Cl.
*B41J 2/02* (2006.01)

(52) U.S. Cl.
USPC ..... 347/74; 347/75; 347/89

(58) Field of Classification Search
USPC ..... 347/74, 78, 75, 89
See application file for complete search history.

(56) References Cited

U.S. PATENT DOCUMENTS 4,847,631 A 7/1989 Naruse et al.
5,363,124 A * 11/1994 Arway ..... 347/74
7,080,897 B2 7/2006 Yang

FOREIGN PATENT DOCUMENTS

JP 61-244556 10/1986
JP 62-199452 9/1987

OTHER PUBLICATIONS

English translation of Office Action for corresponding Japanese Application No. 2010-52973 dated Jul. 31, 2014.

* cited by examiner

*Primary Examiner* — Lam S Nguyen
(74) *Attorney, Agent, or Firm* — Joseph A. Yosick

(57) ABSTRACT

An ink droplet generation module for a print head assembly for a continuous ink jet printer, the printer having an ink supply system, a control system and a power supply system. The ink droplet generation module includes a supporting plate, an ink droplet generator, a charge electrode assembly, deflector plates, a phase measurement assembly, and a gutter tube, all attached to the supporting plate.

5 Claims, 7 Drawing Sheets

INK DROPLET GENERATION MODULE

RELATED APPLICATIONS

This application is a Divisional of U.S. application Ser. No. 12/680,980, filed Mar. 31, 2010, which claims priority under 35 U.S.C. §371 from PCT Application No. PCT/US2008/079484, filed in English on Oct. 10, 2008, which claims the benefit of Great Britain Application Serial No. 0719992.0 filed on Oct. 12, 2007, the disclosures of all of which are incorporated by reference herein in their entireties.

The present invention relates to ink jet printing and more particularly to a print head assembly for an ink jet printer such as a continuous ink jet printer.

BACKGROUND

In ink jet printing systems the print is made up individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurised ink to a print head assembly, which has a heater for raising the temperature of the ink to a controlled temperature and a drop generator where a continuous stream of ink emanating from a nozzle is broken up into individual regular drops by an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. A phase measurement system is also usually present as part of deflection plate assembly and is used to ensure synchronisation of deflection for the droplets. The charged drops bypass the gutter and hit the substrate at a position determined by the charge on the drop and the position of the substrate relative to the print head assembly. Typically the substrate is moved relative to the print head assembly in one direction and the drops are deflected in a direction generally perpendicular thereto, although the deflection plates may be oriented at an inclination to the perpendicular to compensate for the speed of the substrate (the movement of the substrate relative to the print head assembly between drops arriving means that a line of drops would otherwise not quite extend perpendicularly to the direction of movement of the substrate).

In continuous ink jet printing a character is printed from a matrix comprising a regular array of potential drop positions. Each matrix comprises a plurality of columns (strokes), each being defined by a line comprising a plurality of potential drop positions (e.g. seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

The heater in the print head assembly ensures that the viscosity of the ink, which varies with the ink temperature, is maintained at a value such that the drop generator in the print head assembly works effectively. If the ink is too viscous, because its temperature is too low, or too thin, because it is too hot, then the ink stream will not break up into suitable droplets.

Ink is delivered under pressure to the print head assembly from an ink supply system that is generally housed within a sealed compartment of a cabinet that includes a separate compartment for control circuitry and a user interface panel. The system includes a main pump that draws the ink from a reservoir or tank via a filter and delivers it under pressure to the print head assembly. As ink is consumed the reservoir is refilled as necessary from a replaceable ink cartridge that is releasably connected to the reservoir by a supply conduit. The ink is fed from the reservoir via a flexible delivery conduit to the print head assembly. Electrical power to operate the heater in the print head assembly and the drop generator are supplied by power supply system cables, typically forming part of the supply conduit The unused ink drops captured by the gutter are recirculated to the reservoir via a return conduit, typically located as part of the supply conduit, by a pump. The flow of ink in each of the conduits is generally controlled by solenoid valves and/or other like components.

As the ink circulates through the system, there is a tendency for it to thicken as a result of solvent evaporation, particularly in relation to the recirculated ink that has been exposed to air in its passage between the nozzle and the gutter. In order to compensate for this "make-up" solvent is added to the ink as required from a replaceable ink cartridge so as to maintain the ink viscosity within desired limits when the ink is at the correct operating temperature. This solvent may also be used for flushing components of the print head assembly, such as the nozzle and the gutter, in a cleaning cycle.

It will be appreciated that circulation of the solvent requires further fluid conduits and therefore that the ink supply system as a whole comprises a significant number of conduits connected between different components of the ink supply system and the print head assembly. Ideally, the print head assembly is as small as possible to allow for flexibility of use, and will contain both the heater and the droplet generator, charge electrode, deflector plates, phase measurement system and gutter, as well control valves for controlling the flow of ink and solvent, conduits connecting these to the ink supply system and to each other, and electrical connectors to supply power to the various components. Typically, conduits for ink and solvent, as well as connections for the control system (usually electrical connections but other control systems such as hydraulic control systems could be used), and power supply cables, are bundled together to form a supply conduit leading from the printer cabinet to the print head assembly.

The many connections between the components and the conduits within the print head assembly all represent a potential source of leakage and loss of pressure. Moreover, the complexity and compactness of the print head assembly mean that when a component in the print head assembly fails, it is generally necessary to retire the print head assembly and either send it for repair or scrap and replace it, whilst an entire replacement print head assembly may have to be used to ensure continuity of production. On-site repairs would not be feasible, as the presence of multiple conduits and components in the interior of the print head assembly makes access to certain components difficult in the event of servicing or repair.

Given that continuous ink jet printers are typically used on production lines for long uninterrupted periods, reliability of parts, rapidity of repair of parts and ease of maintenance of parts may be important issues.

BRIEF DESCRIPTION

The present disclosure provides a print head assembly for an ink jet printer.

Hence, a first aspect of the invention provides a print head assembly for an continuous ink jet printer, said printer having a control system, a power supply system and an ink and/or solvent supply system, the print head assembly comprising an ink droplet generator and being adapted to releasably house a first module, the first module comprising a heater, a first manifold assembly defining a plurality of first fluid paths for conducting ink and/or solvent through the first module, a valve assembly for enabling said control system to select the first fluid paths through the manifold assembly and/or heater, first fluid ports for connection of the manifold assembly to the ink and/or solvent supply system and to the ink droplet generator, and first control system connectors and power supply system connectors for connection of the valve assembly and the heater to said control system and power supply system respectively, whereby the first module is independently attachable to and detachable from the print head assembly.

A second aspect of the invention provides a continuous ink jet printer comprising a control system, a power supply system, an ink and/or solvent supply system and a print head assembly according to the first aspect of the invention.

By "independently" is meant that the first module, with its required connections to the ink and/or solvent supply system, the control system, the power supply system, and the other components of the print head assembly, can be attached to or detached from the print head assembly without the need to remove such other components or to disconnect such other components from the ink and/or solvent supply system, the control system or the power supply system. Hence, the maintenance of the print head assembly is greatly facilitated. Furthermore, any improvements to components can be easily incorporated into an existing ink jet printer by replacing an outdated module by a new replacement module, containing the upgraded component and designed to fit the print head assembly.

The print head assembly of the first or second aspects of the invention may also be adapted to hold a second module, the second module comprising the ink droplet generator, a second manifold assembly defining second fluid paths for conducting ink and/or solvent to the ink droplet generator, second fluid ports for connection of the second manifold assembly to the first manifold assembly, and second control system connectors and second power supply system connectors for connection of the ink droplet generator to said control system and power supply system respectively, whereby the second module is independently attachable to and detachable from the print head assembly.

The first module is also referred to hereinbelow as the heater module, and the second module as the droplet generation module.

Hence, a third aspect of the invention provides a heating module for a print head assembly for a continuous ink jet printer, said printer having an ink and/or solvent supply system, a control system and a power supply system, the heating module comprising a heater, a manifold assembly defining a plurality of fluid paths, fluid ports in fluid connection with the manifold assembly for connection to said ink and/or solvent supply system, a valve assembly for enabling said control system to select the fluid paths through the manifold assembly and/or heater, and control system and power supply system connectors for connection of the valve assembly and the heater to said control system and power supply system respectively.

A fourth aspect of the invention provides an ink droplet generation module for a print head assembly for a continuous ink jet printer, said printer having an ink and/or solvent supply system, a control system and a power supply system, the ink droplet generation module comprising a ink droplet generator, a manifold assembly defining fluid paths for conducting ink and/or solvent to the ink droplet generator, fluid ports in fluid connection with the manifold assembly for connection to said ink and/or solvent supply system and control system and power supply connectors for connection of the ink droplet generation module to said control system and power supply system respectively.

The following details, preferred aspects and embodiments of the invention are applicable to the first, second, third and fourth aspects of the invention, where appropriate. They also apply to further replaceable modules which may form part of the invention.

The fluid ports for connecting to the ink and/or solvent supply system may be connected either directly to that system, or through other modules as appropriate.

The ink and/or solvent supply system is preferably an ink and solvent supply system, such that the print head assembly may be cleaned by running solvent, instead of ink through the fluid paths of the modules. The fluid paths within the print head are controlled by the control system, typically a microprocessor control system running a computer program, actuating valves in the valve assembly. For instance, when solvent, rather than ink, is flushed through the print head assembly, the valves of the valve assembly may by configured to ensure that the solvent does not pass through the heater. The valve assembly will suitably comprise a plurality of solenoid-operated control valves.

The heater will be situated in one of the fluid paths such that it can heat the ink. There will suitably also be a temperature sensor in the print head assembly, typically in the heater module or in the ink droplet generator module, connected to the control system to provide a feedback signal for use in controlling the ink temperature by means of the heater. The heater may be an electrical heater such as a resistive heater.

The ink droplet generator module, in addition to an oscillating piezoelectric element and any control circuitry therefor (which is termed herein as "the ink droplet generator"), may typically also comprise a charge electrode assembly for charging the ink drops, deflector plates, a phase measurement assembly and a gutter tube for collection and return of undeflected ink droplets. However, these other components may be located elsewhere within the print head assembly, and may be located within a further independently replaceable module or modules. Preferably, these aforementioned components are all part of the ink droplet generator module.

The use of a manifold in either or both of the heater and ink droplet generator modules of the invention obviates the need for many pipe, tubes, hoses or the like that interconnect the components within each module such that the module becomes more reliable and less prone to leakage or breakage at connections. Only connections at the external fluid ports need to made or broken when a module is attached or detached to the rest of the print head assembly.

The manifold may be formed from tubes or pipes within the module, but preferably, the manifold assembly of any replaceable module, such as the heater module and/or the ink droplet generator module, comprises first and second members configured to fit together at interfacing first surfaces and to form therebetween fluid conduits that define the fluid paths in the manifold assembly, and fluid ports in fluid communication with the conduits.

The conduits may be defined by channels in one or both of the first surfaces. Each of the channels may be covered along its length by the opposite first surface when the first and second members are fitted together. The channels may be elongate.

At least one seal may be provided between the interfacing first surfaces in order to seal said conduits against leakage. The seal may be a resilient element that is preferably compressed between the surfaces. There may be discrete seals provided for each channel or one or more seals may be interconnected. The at least one seal may be conveniently received in at least one recess formed on one of said first surfaces.

The channels may be defined either or both of the surfaces. In one embodiment they are provided on the first surface of the first member and the at least one recess is defined on the other first surface of the second member.

Each of the first and second manifold members may have a second surface opposite the first surface. The ports may extend between said first and second surfaces of at least one of the manifold members.

The components that are connected to said ports may be supported by the manifold assembly and may be supported on at least one of the second surfaces.

At least one of the ports may be defined at least in part by a nozzle on the second surface to allow, for instance, for ready attachment of flexible tubing in order to make fluid connection. Suitably, the modules are connected to the ink and/or solvent supply system and to each other by means of flexible tubing adapted to make fluid tight connection with the nozzles.

The components of the modules may be connected directly to the ports and they may be disposed adjacent to said manifold assembly.

The first and second manifold members may take any convenient form. For instance, they may be substantially plate-like. They may be releasably connected together or they may be permanently connected together, for instance by a welded joint.

A suitable configuration for the print head assembly is for it to be in the form of a chamber having a supply conduit connecting it to the control system, the power supply system and the ink and/or solvent supply system of the printer and having connectors for the control system, the ink and solvent supply system and the power supply system located in the chamber. The chamber also suitably comprises attachment means for holding the heater and/or ink droplet generator modules. The connectors for the ink and/or solvent supply system will typically be in form of ports or nozzles on the chamber and on the first and/or second modules, which may be connectable to each other by means of flexible tubing. The control system and power system connectors many be in the form of plug and socket arrangements, or other suitable electrical connections. Suitably, these connectors may be adapted to make contact automatically when the heater and/or ink droplet generator modules are attached to the chamber. For instance, the chamber may be provided with resilient contacts which are adapted to press against contact plates on a module, when the module is attached to the chamber. The chamber may also be provided with a releasable cover in order to provide protection for the modules and their connections within the print head chamber.

It is within the scope of the invention for the print head assembly to comprise further modules, in addition to the heater and/or ink droplet generator module, containing components of the print head assembly, which are also independently attachable to and detachable from the print head assembly. For instance, the ink droplet generator module could contain the piezoelectric element and charge element, while a third module would contain the deflector electrodes, phase measurement system and gutter. Many combinations of different components as independently replaceable modules can be envisaged.

A specific embodiment of the present invention will now be described, by way of example only, with reference to the accompanying drawings.

DETAILED DESCRIPTION

Figure 1:
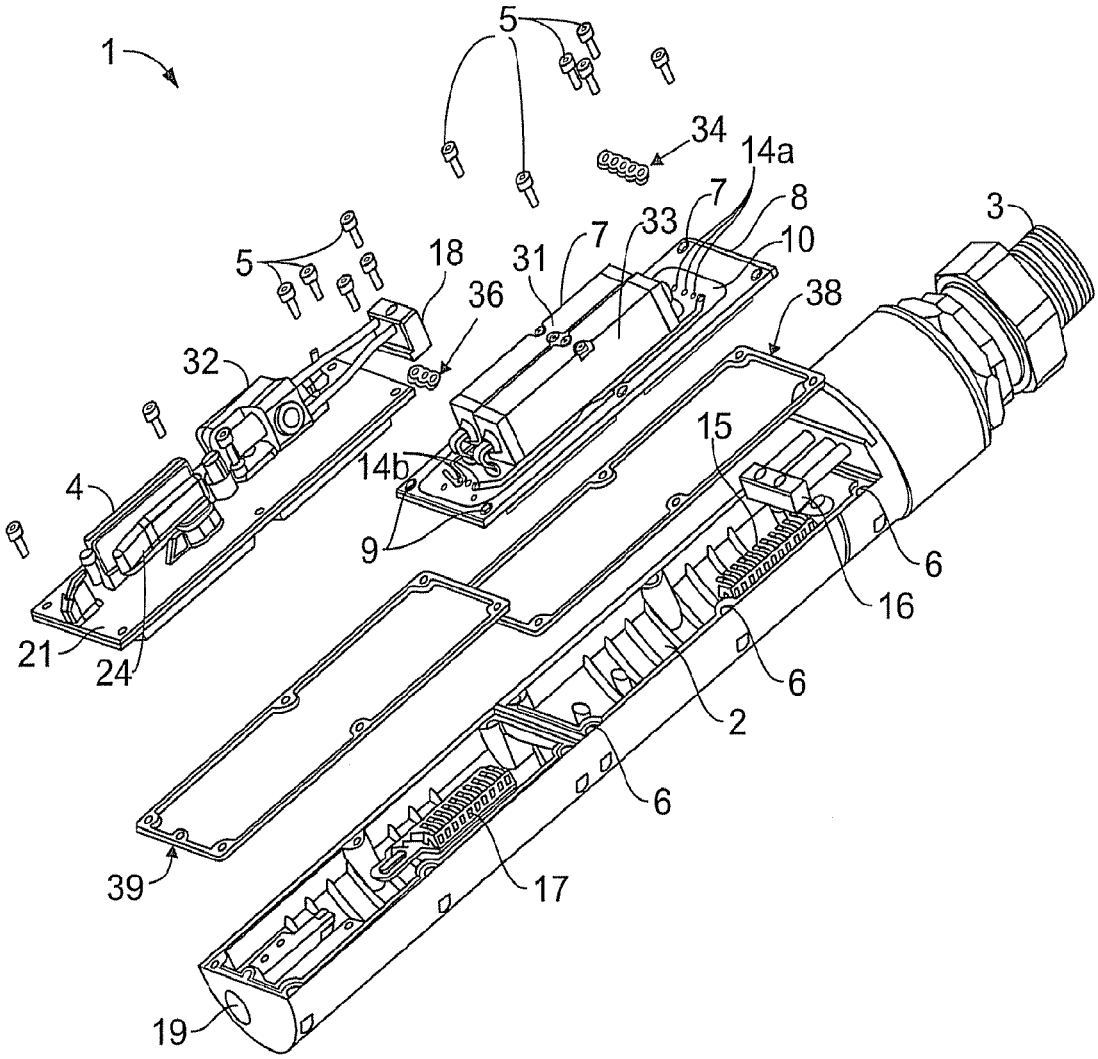
FIG. 1 shows an exploded view of an embodiment of a print head assembly for a continuous ink jet printer.

Referring now to FIG. 1, this shows a print head assembly 1 having a chamber 2 connected to a supply conduit 3 linking the print head assembly 1 to the rest of the printer (not shown). An ink droplet generator module 4 is shown attached to the chamber 2 by bolts 5 mating with tapped holes 6. A seal or gasket 39 may be disposed between ink droplet generator module 4 and chamber 2. The ink droplet generator 4 module (described in further detail below) may include such elements as a piezoelectric element acting as ink droplet generator, a charge electrode, deflector plates, a phase measurement system, a gutter and an exit region 19 where the droplets are printed.

A heater module 7 has a plate 8 having holes 9 by means of which it may be attached to the chamber 2 using the bolts 5 in the tapped holes 6. A seal or gasket 38 may be disposed between heater module and chamber 2. A shim 10 is welded to the plate 8 forming a heater module manifold with fluid pathways formed between grooves (described below and shown in FIG. 7) in the plate 8 and the shim 10. Solenoid valves 31, 33 are attached to the shim 10 and are in fluid connection with the heater module manifold through holes in the shim (not shown). Electrical leads 12 connect the valves 31, 33 to the circuit board 44 (shown in FIG. 2) via holes in the shim and plate. An electrical heater 40 (shown in FIG. 2) is located in, or adjacent to, one of the fluid pathways. The fluid pathways in the manifold are in fluid connection with ports 14A and 14B on the shim 10. The chamber 2 has an circuit board 15 adapted to be in electrical connection with circuit board 44. The circuit board 44 is connected to the control system leads and power supply system leads in the supply conduit 3 by connecting leads (not shown).

Figure 1A:
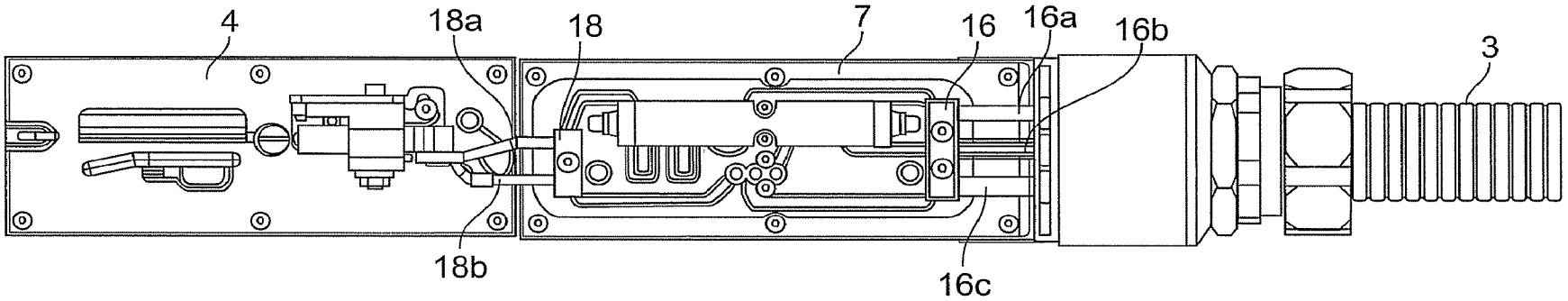
FIG. 1A shows a top view of the print head assembly of FIG. 1.

As also shown in FIG. 1A, the chamber 2 also includes fluid connector or port 16 which is in fluid connection with the ink and solvent supply system of the printer via the supply conduit 3. Fluid connector 16 is disposed over shim 10 to provide fluid connection between the supply conduit 3 and openings or ports 14A in the manifold. A gasket 34 is preferably disposed between connector 16 and ports 14A. Fluid connector 16 may be attached to various fluid feed and return lines, such as ink feed line 16A, solvent feed line 16B, and ink/solvent return line 16C. Thus, in one embodiment, connector 16 and ports 14A provide for connections for three separate fluid channels. Fluid connector or port 18 is disposed over shim 10 to provide fluid connection between the supply conduit 3 and openings or ports 14B in the manifold. A gasket 36 is preferably disposed between connector 18 and ports 14B. Tubes 18A and 18B provide fluid connections between the connector 18 and droplet generator 32. Thus, in one embodiment, connector 18 and ports 14B may provide connections for two separate fluid channels. Although a particular mechanical configuration of fluid connection between connector 16 and ports 14A, and connector 18 and ports 14B, is shown, it will be apparent that other variations of connections are possible using various tubes, channels, holes, nozzles, and so forth.

Figure 2:
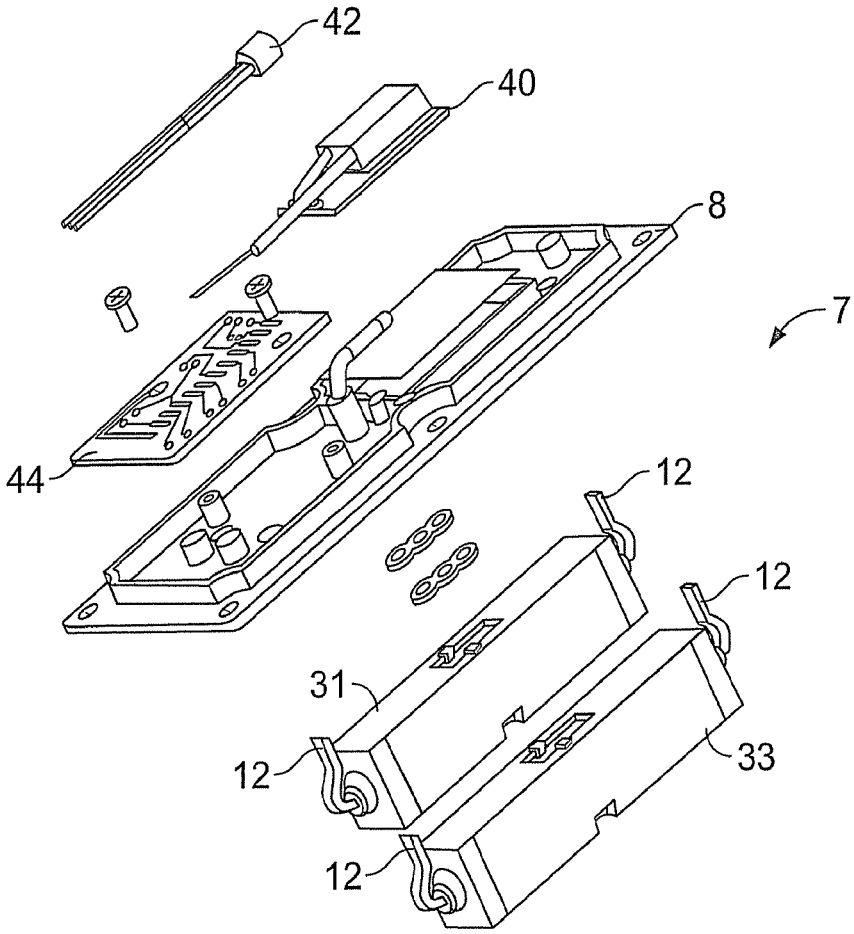
FIG. 2 shows an exploded view of a heater module of the print head assembly of FIG. 1.
Figure 4:
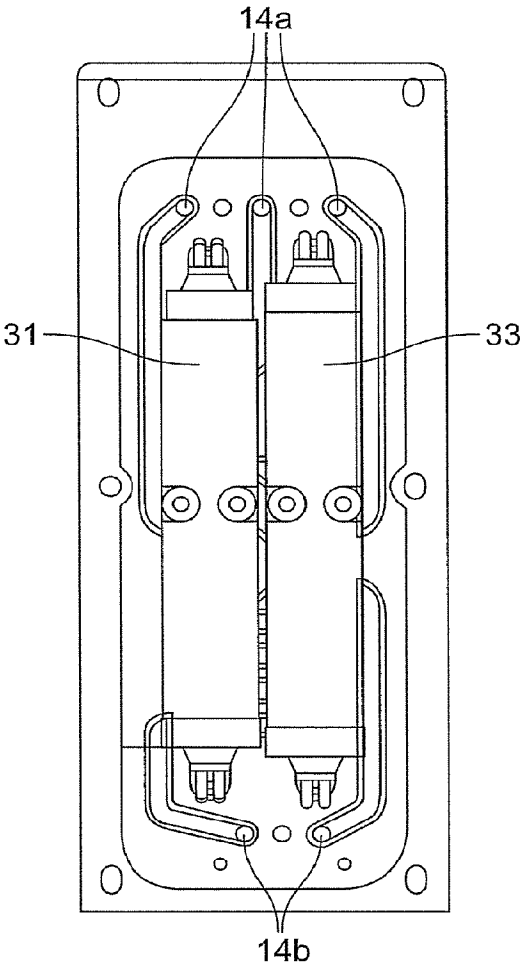
FIG. 4 shows a top view of the heater module of FIG. 2.
Figure 3:
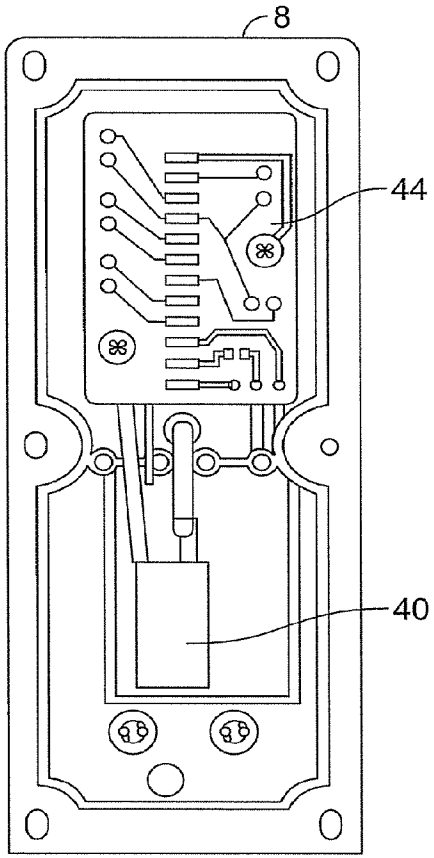
FIG. 3 shows a bottom view of the heater module of FIG. 2.

An exploded view of the components of the heater module 7 is shown in FIG. 2. On one surface of the plate 8 is disposed the ink and solvent valve 31 and the gutter valve 33. On the opposite surface of the plate 8 is disposed a heater 40, a temperature sensor 42, and circuit board 44. Heater 40 and temperature sensor 42 are used to control the temperature of the ink flowing through the heater module 7. Circuit board 44 is electrically connected to valves 31, 33, heater 40, temperature sensor 42, and other components to control those components. FIG. 3 is a bottom view of the heater module 7 showing the various components attached thereto. FIG. 4 is a top view of the heater module 7 showing the various components attached thereto, as well as showing ports 14A and 14B.

Figure 5:
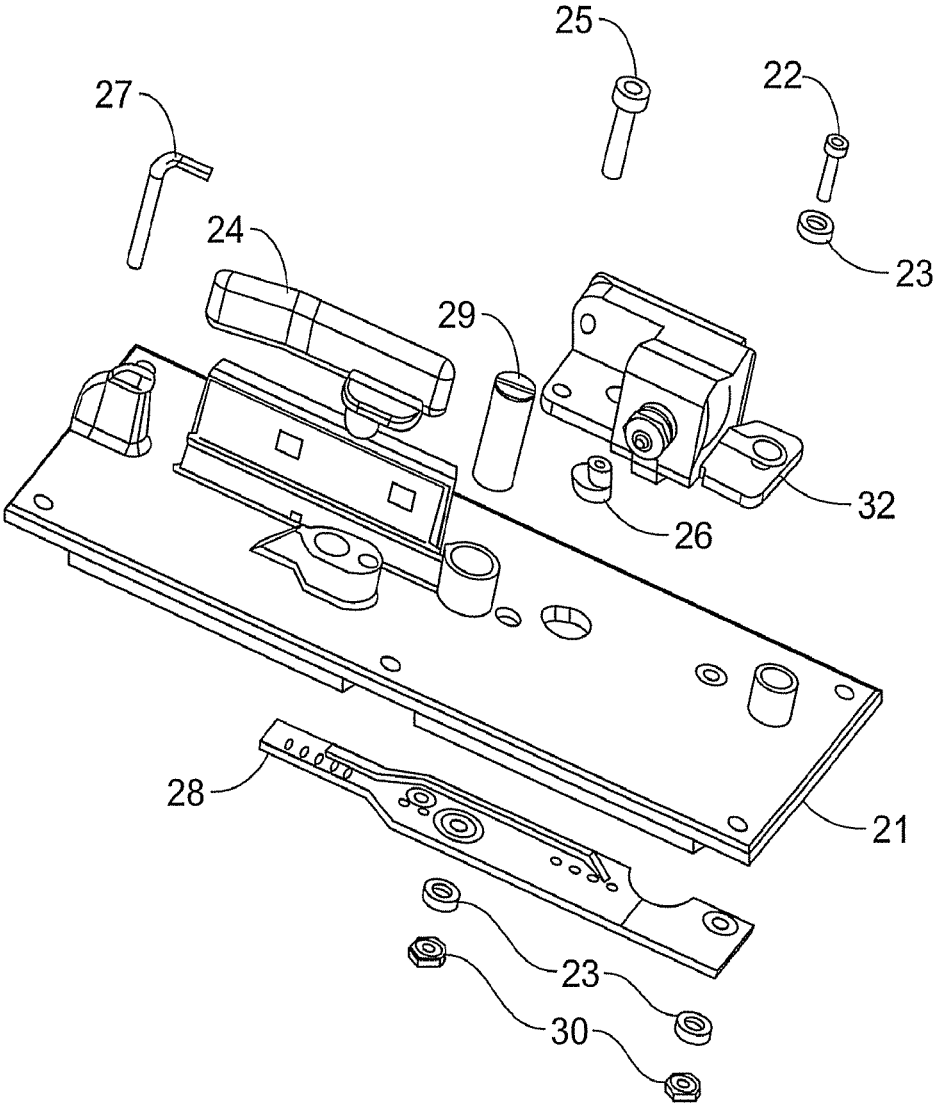
FIG. 5 shows an exploded view of the ink droplet generator module of the print head assembly of FIG. 1.

The ink droplet generator module 4, as also shown in FIG. 5, is in electrical connection with the power supply system and the control system of the printer, which may be by means of a plug and socket arrangement (not shown) located between the ink droplet generator module 4 and the chamber 2, or by other suitable electrical connections. The plate 21 includes a connector 18 attached to it and providing fluidic connection with the fluid pathways in the ink droplet generator manifold of heater module 7. A thermistor (not shown) may be provided in the fluid pathway of the ink droplet generator module 4 and connected to the control system through the plug and socket arrangement to measure the temperature of the ink entering the ink droplet generator module 4.

To assemble the components of the print head assembly 1, the heater module 7 is electrically connected to circuit board 15 and the heater module 7 is mechanically attached to the chamber 2 using the bolts 5. Likewise, the droplet generator 4 is electrically connected to circuit board 17 and the droplet generator is mechanically attached to chamber 12 using bolts 5. The ports 14A of the heater module 7 are connected to connector 16 and the ports 14B of the heater module are connected to the connector 18 of the ink droplet generator module 4. A print head cover (not shown) is placed around the chamber and modules.

When printing, ink passes through the supply conduit 3, through lines 16A, 16B, 16C, via the connectors 16 to the ports 14A, through the fluid pathways, valves 11 and heater 40 of the heater module 7, out of the ports 14B, into the entrance connector 18 of the ink droplet generator module 4 and eventually out of the print head assembly at the printing end 19. Ink collected from the gutter of the droplet formation module (not shown) is returned via one of the connector 18 via a port 14B, through the heater module manifold to a port 14A into a connector 16 and back to the printer via the supply conduit 3. The control system uses the measured temperature of the ink in order to control the heater, enabling a predetermined ink temperature to be maintained.

When it is necessary to replace or maintain the heater module 7 or the ink droplet generator module 4, it is necessary only to remove the print head cover (not shown), then to disconnect connector 16 or 18 of the relevant module 4 or 7, to unfasten the bolts 5 and to detach the module 4 or 7 whilst decoupling the electrical connection. A replacement module 4 or 7 can be put in place by simply reversing the previous process.

Referring now to FIG. 5, this shows an exploded view of the ink droplet generator module 4. A supporting plate 21 has attached to it the deflector plate 24 including the phase measurement electrode. The circuitry associated with the phase measurement is located on a printed circuit board 28 which is on the opposite side of the plate 21 to the piezoelectric droplet generator 32. The phase measurement printed circuit board 28 and piezoelectric droplet generator 32 are attached to the plate 21 by bolts 22, 25 washers 23 and nuts 30. An eccentric socket 26 locks the piezoelectric droplet generator 32 in place. The charge electrode assembly 29 fits into the deflector plate assembly 24 as shown. The gutter tube 27 is locked into the supporting plate 21 by means of a grub screw 11.

Figure 6:
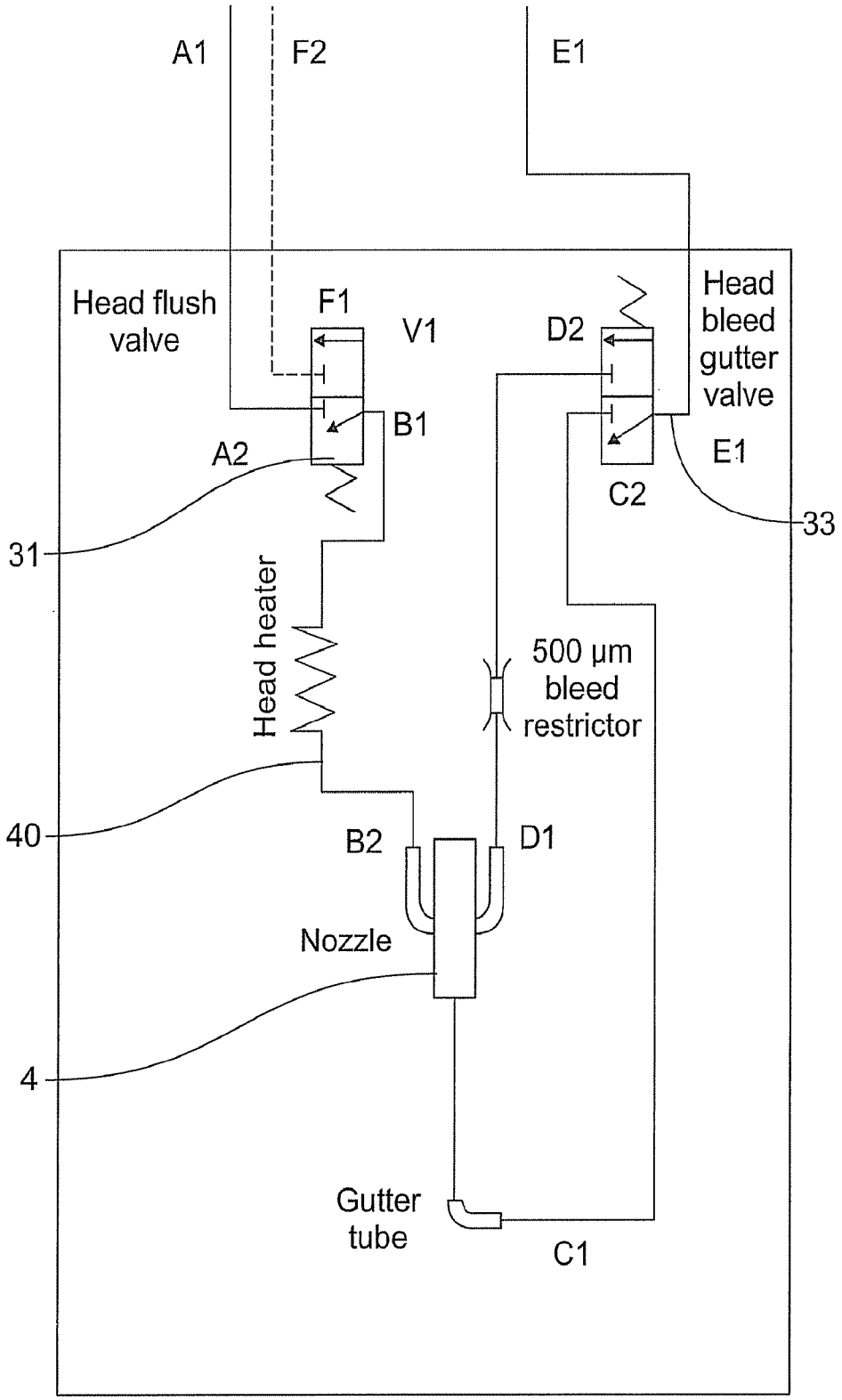
FIG. 6 shows a schematic diagram of the fluidic channels in the print head assembly of FIG. 1.
Figure 7:
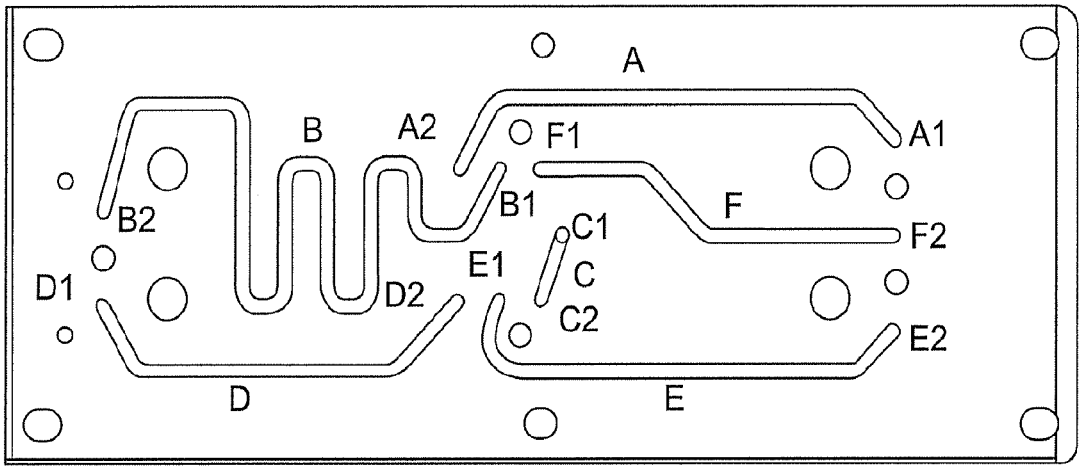
FIG. 7 shows the channels in the heater module of the print head assembly of FIG. 1.

Referring now to FIGS. 6 and 7, these show respectively a schematic diagram of the fluidic grooves in the print head assembly 1 of the embodiment, and the configuration of the channels in the heater module plate 8 of the embodiment. In use, a platen 10 welded to the plate 8 closes off the grooves to form fluidic channels or a manifold. The channels serve the following functions:

A—fluid under pressure (either ink or solvent, but preferably only ink) passes from the ink and solvent supply system of the printer via the supply conduit 3 from A1 to A2 and is delivered to the feed valve 11.

B—passes fluid through the feed valve 31 to the ink droplet generator module 4 via the heater 40, from B1 to B2.

C—is the return line from the gutter tube to the gutter valve 33, allowing undeflected ink or solvent droplets collected in the gutter to be returned to the ink reservoir of the printer, from C1 to C2.

D—is a bleed line. When the bleed control valve 33 is actuated, ink passes back through this bleed line prior to initiating cleaning of the ink droplet generator with solvent, from D1 to D2.

E—provides a channel for returning ink and solvent back to the ink supply system via the supply conduit 3, from E1 to E2.

F—provides a channel for supplying clean solvent via the supply conduit and to the control valve 31 for use in flushing the ink droplet generator when necessary, from F2 to F1.

Although a particular arrangement of channels and ports is shown in the manifold of FIG. 7, it will be apparent that other configurations are possible for use in the print head assembly 1.

It will be appreciated that numerous modifications to the above described embodiment may be made without departing from the scope of the invention as defined in the appended claims. For example, the ink droplet generator may not be in modular form, or the fluid pathways within the heater module may be made by tubed connections rather than by means of channels formed between a plate and a shim or between two plates.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

What is claimed is:

1. A print head assembly for a continuous ink jet printer, the printer having an ink supply system, a control system and a power supply system, comprising an ink droplet generation module comprising:

a supporting plate;

an ink droplet generator, a charge electrode assembly, deflector plates, a phase measurement assembly, and a gutter tube, all attached to the supporting plate;

fluid paths for conducting ink to the ink droplet generator;

fluid ports in fluid connection with the fluid paths for connection to the ink supply system; and control system and power supply connectors for connection of the ink droplet generation module to the control system and power supply system respectively, wherein the module is independently attachable to and detachable from the print head assembly;

further comprising a heater module releasably housed within the print head assembly, the heater module comprising:

a heater;

a manifold assembly defining a plurality of first fluid paths for conducting ink through the heater module;

a valve assembly for enabling the control system to select the first fluid paths through the manifold assembly;

fluid ports for connection of the manifold assembly to the ink supply system and to the ink droplet generator; and control system connectors and power supply system connectors for connection of the valve assembly and the heater to the control system and power supply system, respectively, of the printer, wherein the valve assembly comprises a first valve for controlling fluid flow to the ink droplet generator and a second valve for controlling fluid flow returned to the ink supply system, wherein the heater module comprises a plate, with the heater and the valve assembly disposed on the plate, and the heater module is independently attachable to and detachable from the print head assembly.

2. The ink droplet generation module of claim 1 further comprising circuitry associated with the phase measurement assembly located on a printed circuit board disposed on an opposite side of the plate to the ink droplet generator.

3. The ink droplet generation module of claim 1 wherein required connections of the module to other components of the print head assembly can be attached to or detached without the need to remove or disconnect the other components from the print head assembly.

4. The ink droplet generation module of claim 1 wherein the droplet generator is secured to the plate by an eccentric socket.

5. The print head assembly of claim 1, wherein the fluid ports of the heater module comprise a first set of first fluid ports disposed on a first end of the plate and second set of first fluid ports disposed at a second end of the plate opposite the first end.

* * * * *